US011478911B2

(12) United States Patent
Wu

(10) Patent No.: US 11,478,911 B2
(45) Date of Patent: Oct. 25, 2022

(54) SNAP RING PLIERS

(71) Applicant: Pi-Liang Wu, Taichung (TW)

(72) Inventor: Pi-Liang Wu, Taichung (TW)

( * ) Notice: Subject to any disclaimer, the term of this patent is extended or adjusted under 35 U.S.C. 154(b) by 223 days.

(21) Appl. No.: 16/815,011

(22) Filed: Mar. 11, 2020

(65) Prior Publication Data

US 2020/0306939 A1 Oct. 1, 2020

(51) Int. Cl.
*B25B 27/20* (2006.01)

(52) U.S. Cl.
CPC ..... *B25B 27/205* (2013.01)

(58) Field of Classification Search
CPC .... B25B 7/00; B25B 7/02; B25B 7/04; B25B 7/06; B25B 7/10; B25B 7/12; B25B 7/14; B25B 7/18; B25B 9/00; B25B 9/02; B25B 25/00; B25B 25/005; B25B 27/00; B25B 27/20; B25B 27/205; B25F 1/00; B25F 1/003; B25F 1/04
See application file for complete search history.

(56) References Cited

U.S. PATENT DOCUMENTS 1,334,971 A * 3/1920 Shore ..... B25B 5/10 269/3
3,365,782 A * 1/1968 Madeira ..... B25B 27/205 29/229
3,662,449 A * 5/1972 Hashimoto ..... B25B 27/205 29/229
3,813,750 A * 6/1974 Kerr ..... B25B 27/205 29/229
5,933,935 A * 8/1999 Alcorn ..... B25B 27/20 29/229
6,678,930 B1 * 1/2004 Owoc ..... B25B 27/20 29/229

* cited by examiner

*Primary Examiner* — Robert J Scruggs

(57) ABSTRACT

A snap ring pliers contain: a handle, a first clamper, a second clamper, two clamp feet, and an adjustment structure. The handle includes a connection column. The first clamper includes a first hollow fitting ring, a first arcuate section, a second arcuate section, and a first straight section. The second clamper includes a second hollow fitting ring, a third arcuate section, a fourth arcuate section, and a second straight section. A respective one clamp foot of the two clamp feet includes a shaft inserted into the first straight section or the second straight section. The adjustment structure includes a first post, a second post, a threaded rod, and a sleeve. A direction of a threaded section of the first threaded orifice is opposite to a direction of a threaded section of the second threaded orifice. The threaded rod has a first screwing section and a second screwing section.

3 Claims, 6 Drawing Sheets

SNAP RING PLIERS

FIELD OF THE INVENTION

The present invention relates to a snap ring pliers which are applied to fix and remove snap rings.

BACKGROUND OF THE INVENTION

A conventional snap ring is a mechanical component applied to fix shafts and bearings.

The conventional snap ring is applied to the shafts and holes. When the snap ring is applied to the shafts, it is called as an outer retainer, and when the snap ring is applied to the holes, it is called as an inner retainer. The snap ring is made of metal and is formed in an arcuate sheet, wherein the snap ring has two segments formed on two arcuate ends thereof, and each of the two segments of the snap ring is inserted through a receiving aperture.

As shown in FIG. 1, the pliers are used to fix or remove the snap ring and contain a handle 11, a first clamper 12, a second clamper 13, and an adjustment structure 14. The handle 11 is upright, a top of each of the first clamper 12 and the second clamper 13 is rotatably connected with a connection column 15 of the handle, and two ends of the connection column 15 point to the handle 11 axially, the first clamper 12, and the second clamper 13 so that the first clamper 12 and the second clamper 12 are rotated reciprocately along the connection column 15. The first clamper 12 has a first clamp foot 122 extending from a bottom thereof and inserted into one of the two receiving apertures (not shown) of the snap ring, and the second clamper 13 has a second clamp foot 132 extending from a bottom thereof and inserted into the other receiving aperture of the snap ring, such that the snap ring is forced to deform outward or inward, thus fixing or removing the snap ring.

The adjustment structure 14 has a first post 142, a second post 144, and a threaded rod 146. The first post 142 is formed on a middle section of the first clamper 12, the second post 146 is formed on a middle section of the second clamper 13. The threaded rod 146 has a first screwing section 1462 and a second screwing section 1416, wherein a direction of the first screwing section 1462 extends opposite to a direction of the second screwing section 1416. The first screwing section 1462 passes through the first post 142, and the second screwing section 1464 passes through the second post 142. When the threaded rod 146 is rotated, the first screwing section 1462 forces the first clamper 12 to rotate along the connection column 15, and the second screwing section 1464 urges the second clamper 13 to rotate along the connection column 15, wherein a rotation direction of the first clamper 12 is opposite to a rotation direction of the second clamper 13 so as to change a distance between the first clamp foot 122 and the second clamp foot 132. The threaded rod 146 has a coupling portion 1466 arranged on an end thereof so as to connect with a wrench or other hand tools, such that the threaded rod 146 is rotated by the wrench or the other hand tools to operate the first clamper 12 and the second clamper 13.

The conventional snap ring pliers are applicable for a connection or a removal of a large-sized of snap ring, and the threaded rod 146 is rotated by an auxiliary tool to derive the first clamper 12 and the second clamper 13 to revolve, thus obtaining easy operation.

As illustrated in FIG. 2, when the snap ring is connected or removed by the pliers, the first clamper 12 and the second clamper 13 are driven to rotate along the connection column 15, such that an angle between each of the first clamp foot 122 and the second clamp foot 132 and each receiving aperture is changed, and each of the first clamp foot 122 and the second clamp foot 132 slides relative to and remove from the snap ring, thus causing operation unsafe.

The present invention has arisen to mitigate and/or obviate the afore-described disadvantages.

SUMMARY OF THE INVENTION

The primary objective of the present invention is to a snap ring pliers which are applied to fix and remove a snap ring.

The snap ring pliers provided by the present invention contain: a handle, a first clamper, a second clamper, two clamp feet, and an adjustment structure.

A bottom of the handle is rotatably connected with the first clamper and the second clamper, a respective one of the two clamp feet is formed on a bottom of each of the first clamper and the second clamper, and the adjustment structure is rotatably connected with the first clamper and the second clamper so as to adjust a distance between the two clamp feet.

The handle includes a connection column extending from the bottom thereof. The first clamper includes a first hollow fitting ring, a first arcuate section, a second arcuate section, and a first straight section which are integrally connected, and the second clamper includes a second hollow fitting ring, a third arcuate section, a fourth arcuate section, and a second straight section which are integrally connected. The first hollow fitting ring and the second hollow fitting ring are connected with the handle, the first arcuate section curvedly extends from the first hollow fitting ring and is connected with a top of the second arcuate section, and the third arcuate section curvedly extends from the second hollow fitting ring and is connected with a top of the fourth arcuate section. A bottom of the second arcuate section is connected with a top of the first straight section, and a bottom of the fourth arcuate section is connected with a top of the second straight section, wherein the first hollow fitting ring stacks on the second hollow fitting ring so that the connection column is rotatably inserted through the first hollow fitting ring and the second hollow fitting ring so as to connecting the handle, the first clamper, and the second clamper.

A respective one clamp foot of the two clamp feet is inserted into the first straight section or the second straight section.

The adjustment structure includes a first post, a second post, a threaded rod, and a sleeve, wherein the first post is rotatably connected with the first clamper, the second post is rotatably connected with the second clamper, and the first post passes through a first threaded orifice, the second post passes through a second threaded orifice. A direction of a threaded section of the first threaded orifice is opposite to a direction of a threaded section of the second threaded orifice, the threaded rod has a first screwing section and a second screwing section. A direction of the first screwing section extends opposite to a direction of the second screwing section, the first screwing section passes through the first threaded orifice, and the second screwing section passes through the second threaded orifice, and the sleeve is rotatably connected with the threaded rod.

The respective one clamp foot includes a shaft and an insertion extending from a bottom of the shaft, and the shaft of the respective one clamp foot is inserted into the first straight section or the second straight section, wherein the first straight section has a first screw fixed on a side thereof so as to abut against the shaft, and the second straight section has a second screw fixed on a side thereof so as to abut against the shaft. The first post and the second post are parallel to the connection column.

The first clamper further includes a first tubular portion and a first loop, wherein a top of the first post is rotatably connected with the first tubular portion, a bottom of the first post is rotatably connected with the first loop, such that the first post is fixed by the first tubular portion and the first loop; the second clamper further includes a second tubular portion and a second loop, wherein a top of the second post is rotatably connected with the second tubular portion, a bottom of the second post is rotatably connected with the second loop, such that the second post is fixed by the second tubular portion and the second loop.

Thereby, a snap ring is fixed or is removed by the snap ring pliers. For example, the insertion of the respective clamp foot is inserted into one of two receiving apertures of the snap ring, and the threaded rod is rotated to drive the first clamper and the second clamper to oppositely rotate outward along the connection column, such that a distance between the first straight section and the second straight section and the distance between the two clamp feet are changeable. Since the connection column points to the snap ring, when the first clamper and the second clamper are rotated, the two clamp feet are parallel to a virtual plane of a surface of the snap ring, wherein an angle between each clamp foot and each receiving aperture of the snap ring is not changed, so each clamp foot is connected with the snap ring securely.

DETAILED DESCRIPTION OF THE PREFERRED EMBODIMENTS

Figure 1:
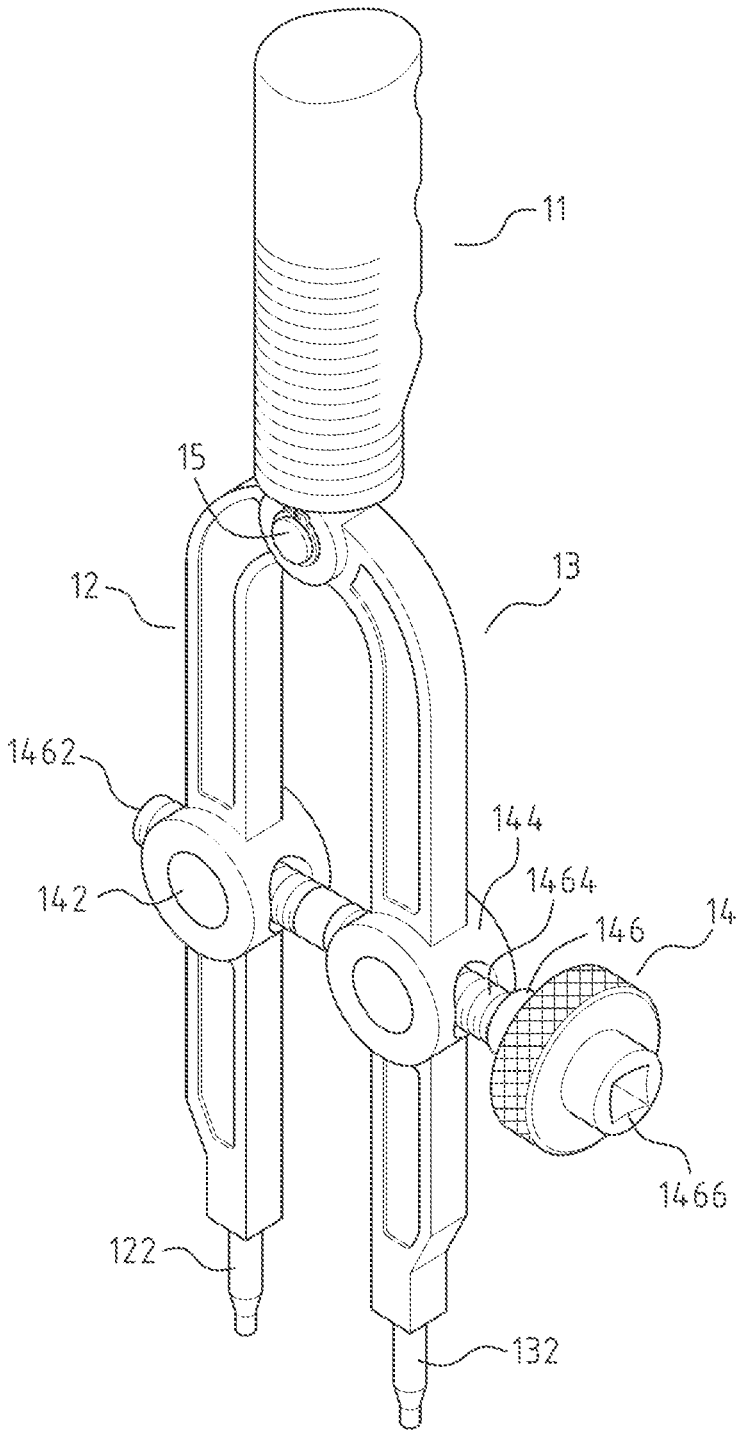
FIG. 1 PRIOR ART
FIG. 1 is a perspective view of conventional snap ring pliers.
Figure 2:
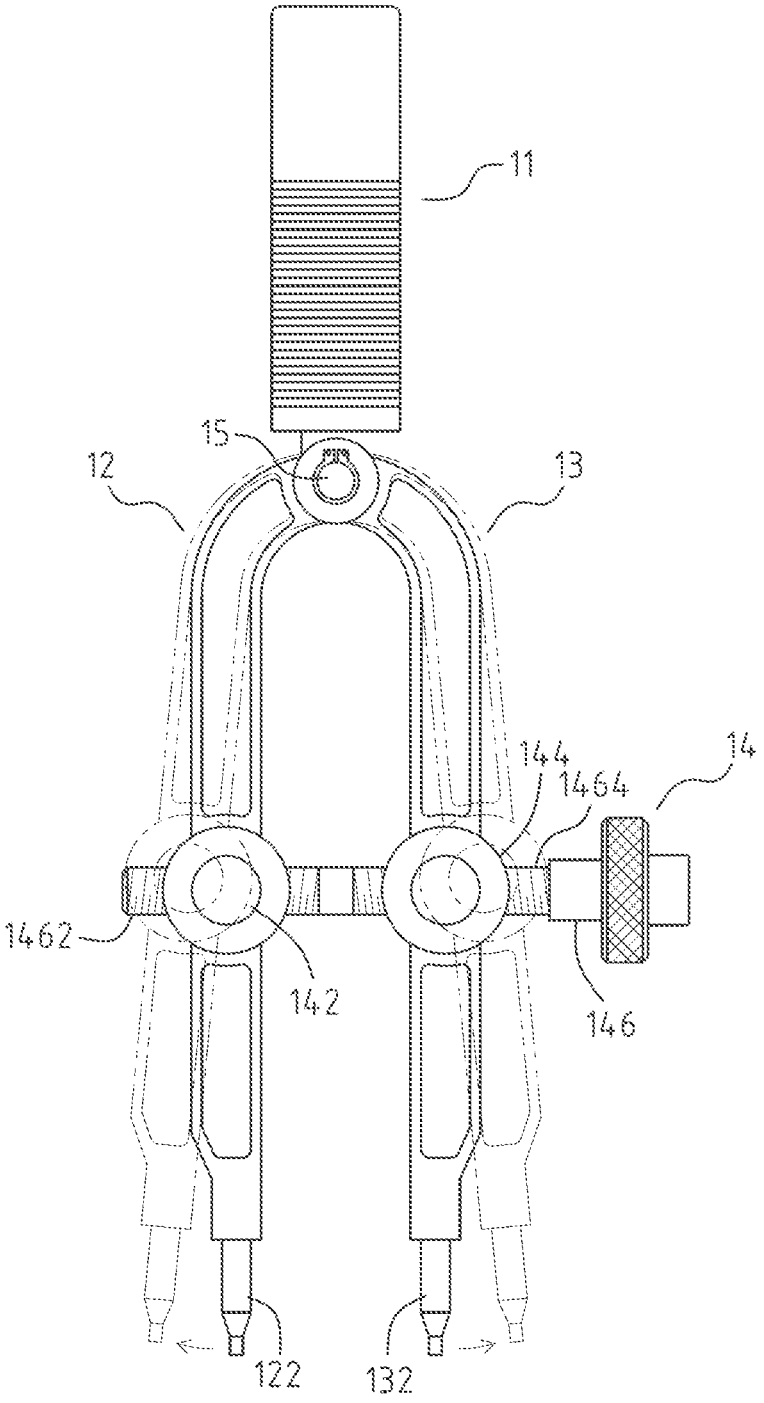
FIG. 2 PRIOR ART
FIG. 2 is a front plan view showing the operation of the conventional snap ring pliers.
Figure 3:
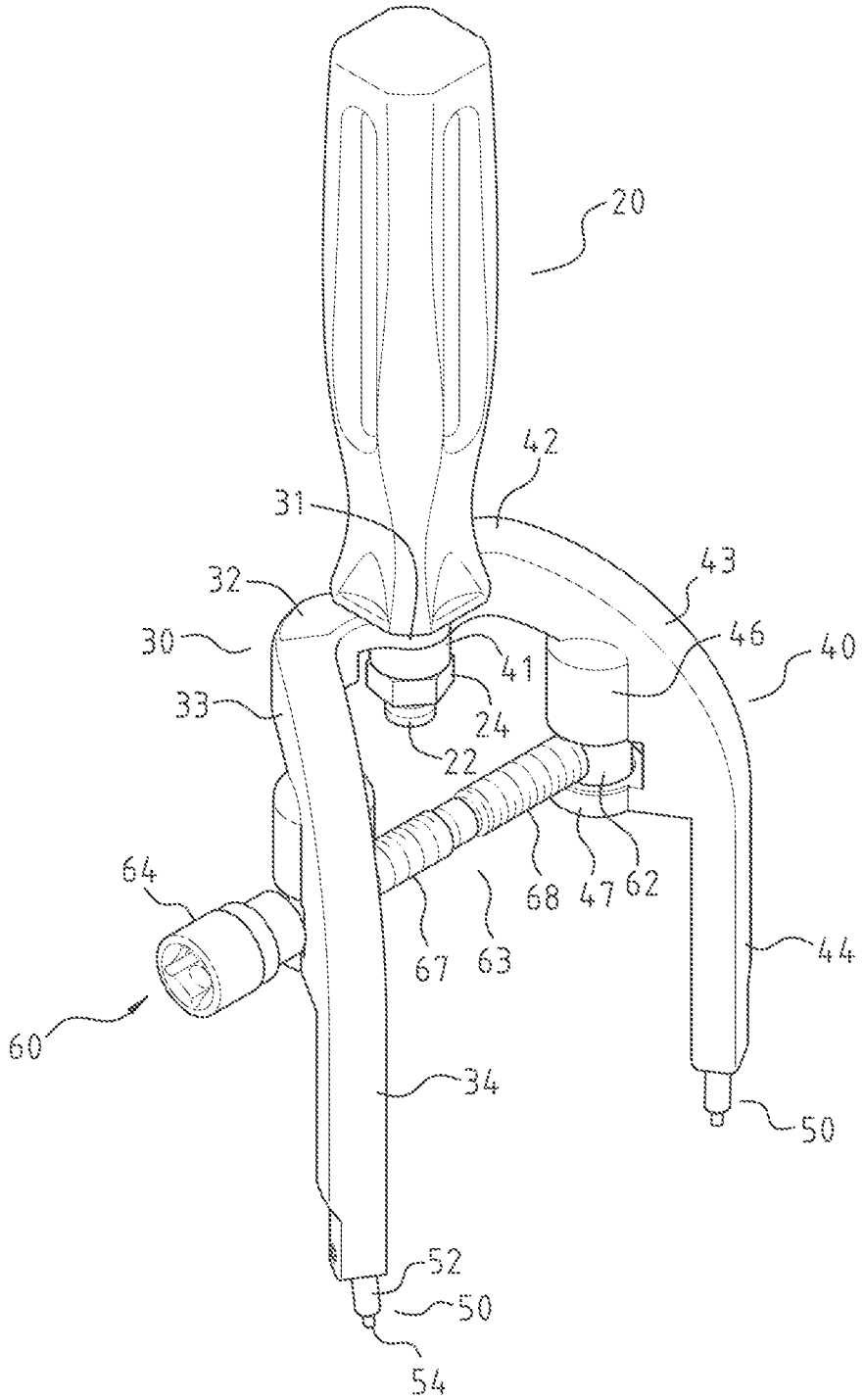
FIG. 3 is a perspective view showing the assembly of a snap ring pliers according to a preferred embodiment of the present invention.
Figure 4:
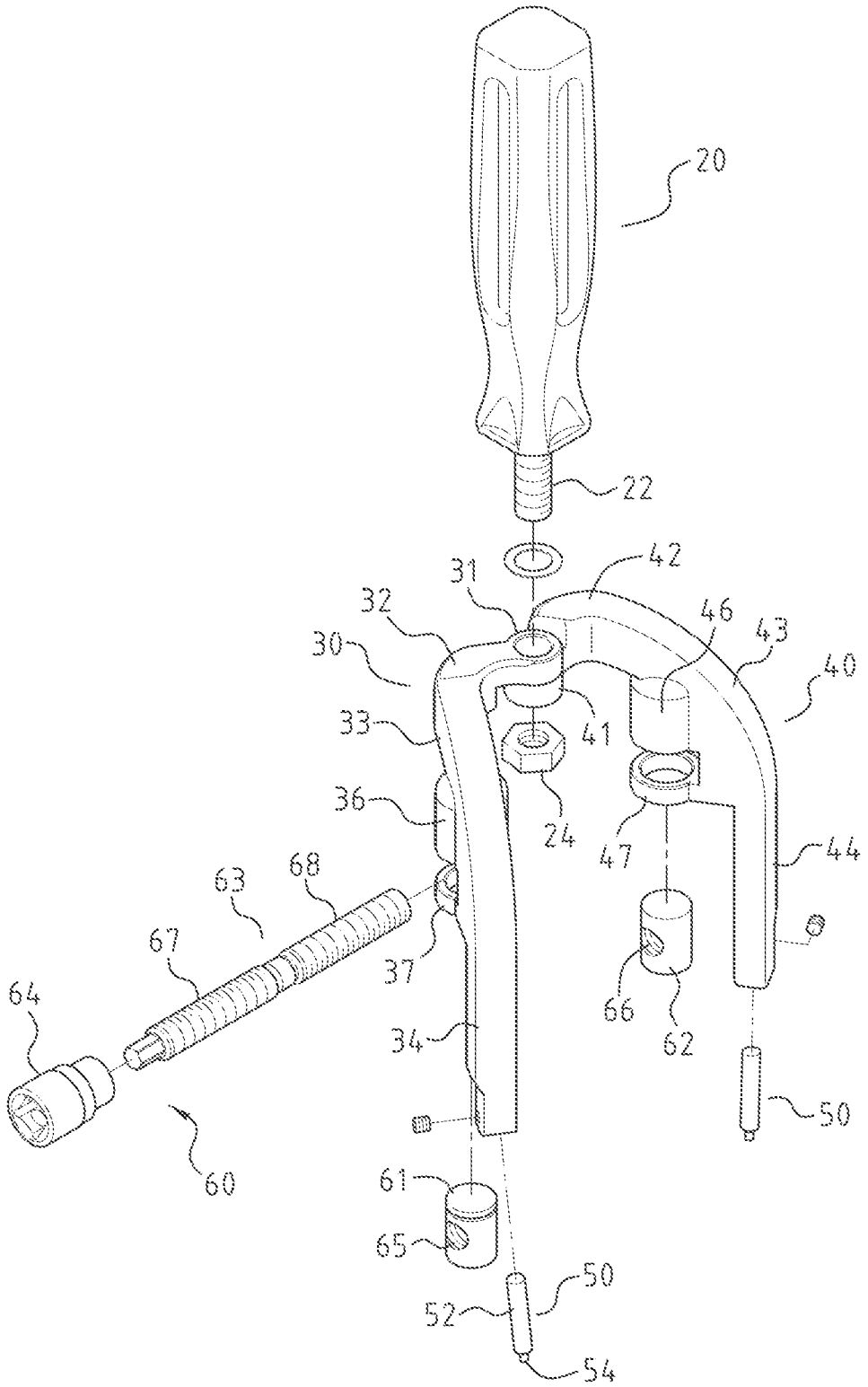
FIG. 4 is a perspective view showing the exploded components of the snap ring pliers according to the preferred embodiment of the present invention.

With reference to FIGS. 3 and 4, a snap ring pliers according to a preferred embodiment of the present invention comprise: a handle 20, a first clamper 30, a second clamper 40, two clamp feet 50, and an adjustment structure 60.

A bottom of the handle 20 is rotatably connected with the first clamper 30 and the second clamper 40 so that the first clamper 30 and the second clamper 40 rotate along the handle 20 reciprocately, wherein a respective one of the two clamp feet 50 is formed on a bottom of each of the first clamper 30 and the second clamper 40. The adjustment structure 60 is rotatably connected with the first clamper 30 and the second clamper 40 so as to adjust a distance between the two clamp feet 50.

The handle 20 includes a connection column 22 extending from the bottom thereof, the first clamper 30 includes a first hollow fitting ring 31, a first arcuate section 32, a second arcuate section 33, and a first straight section 34 which are integrally connected, and the second clamper 40 includes a second hollow fitting ring 41, a third arcuate section 42, a fourth arcuate section 43, and a second straight section 44 which are integrally connected. The first hollow fitting ring 31 and the second hollow fitting ring 41 are connected with the handle 20, the first arcuate section 32 curvedly extends from the first hollow fitting ring 31 and is connected with a top of the second arcuate section 33, and the third arcuate section 42 curvedly extends from the second hollow fitting ring 41 and is connected with a top of the fourth arcuate section 43. A bottom of the second arcuate section 33 is connected with a top of the first straight section 34, and a bottom of the fourth arcuate section 44 is connected with a top of the second straight section 44, wherein the first hollow fitting ring 31 stacks on the second hollow fitting ring 41 so that the connection column 22 is screwed with a screw nut 24 via the first hollow fitting ring 31 and the second hollow fitting ring 41 so that the screw nut 24 stops a bottom of the first hollow fitting portion 31 and the second hollow fitting portion 41, thus rotatably connecting the handle 20, the first clamper 30, and the second clamper 40.

A respective one clamp foot 50 includes a shaft 52 and an insertion 54 extending from a bottom of the shaft 52, and the shaft 52 of the respective one clamp foot 50 is inserted into the first straight section 34 or the second straight section 44, wherein the first straight section 34 has a first screw 35 fixed on a side thereof so as to abut against the shaft 52, and the second straight section 44 has a second screw 45 fixed on a side thereof so as to abut against the shaft 52, hence the respective one clamp foot 50 is connected with the first clamper 30 or the second clamper 40.

The adjustment structure 60 includes a first post 61, a second post 62, a threaded rod 63, and a sleeve 64, wherein the first post 61 is rotatably connected with the first clamper 30, the second post 62 is rotatably connected with the second clamper 40, and the first post 61 and the second post 62 are parallel to the connection column 22. The first post 61 passes through a first threaded orifice 65, the second post 62 passes through a second threaded orifice 66, wherein a direction of a threaded section of the first threaded orifice 65 is opposite to a direction of a threaded section of the second threaded orifice 66. For example, the direction of the threaded section of the first threaded orifice 65 extends leftward, and the direction of the threaded section of the second threaded orifice 65 extends rightward. Alternatively, the direction of the threaded section of the first threaded orifice 65 extends rightward, and the direction of the threaded section of the second threaded orifice 65 extends leftward. The threaded rod 63 has a first screwing section 67 and a second screwing section 68, wherein a direction of the first screwing section 67 extends opposite to a direction of the second screwing section 68, the first screwing section 67 passes through the first threaded orifice 65, and the second screwing section 68 passes through the second threaded orifice 66. When the threaded rod 63 rotates, the first screwing section 67 drives the first clamper 30 to rotate along the connection column 22 via the first post 61, and the second screwing section 68 drives the second clamper 40 to rotate along the connection column 22 via the second post 62, wherein a rotation direction of the first clamper 30 is opposite to the second clamper 40, the sleeve 64 is rotatably connected with the threaded rod 63 and is applicable for an L-type wrench or other hand tools, such that the threaded rod 63 is rotated to operate the first clamper 30 and the second clamper 40 easily.

The first clamper 30 further includes a first tubular portion 36 and a first loop 37, wherein a top of the first post 61 is rotatably connected with the first tubular portion 36, a bottom of the first post 62 is rotatably connected with the first loop 37, such that the first post 61 is fixed by the first tubular portion 36 and the first loop 37. The second clamper 40 further includes a second tubular portion 46 and a second loop 47, wherein a top of the second post 62 is rotatably connected with the second tubular portion 46, a bottom of the second post 62 is rotatably connected with the second loop 47, such that the second post 62 is fixed by the second tubular portion 46 and the second loop 47.

Figure 5:
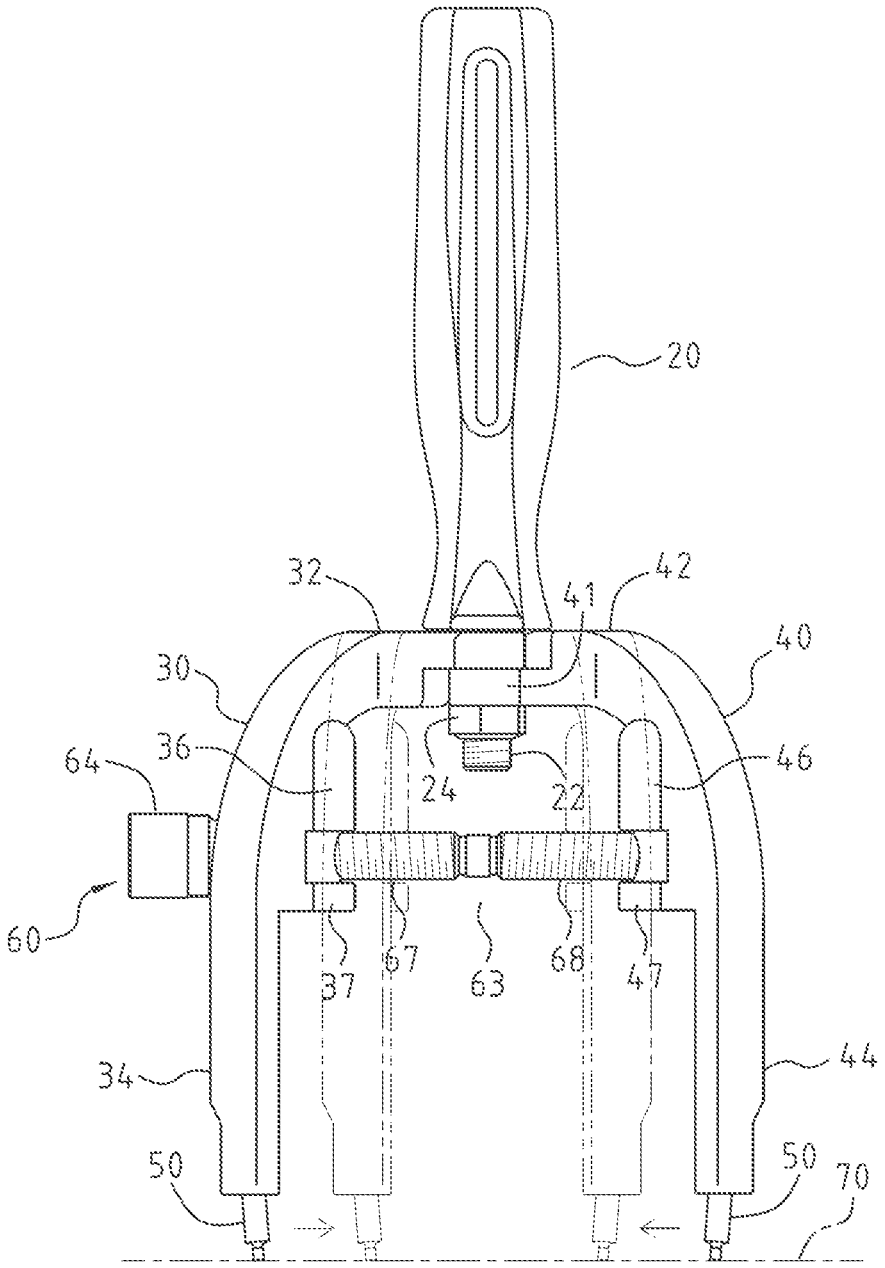
FIG. 5 is a front plan view showing the operation of the snap ring pliers according to the preferred embodiment of the present invention.
Figure 6:
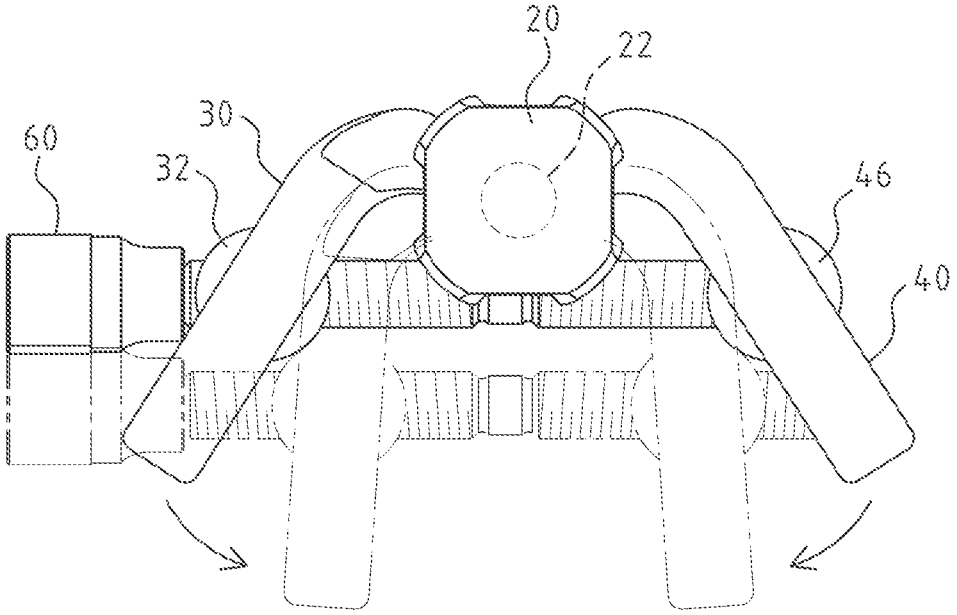
FIG. 6 is a bottom plan view showing the operation of the snap ring pliers according to the preferred embodiment of the present invention.

Referring to FIGS. 5 and 6, a snap ring (not shown) is fixed or is removed by the snap ring pliers of the present invention. The insertion 54 of the respective clamp 50 is inserted into one of two receiving apertures of the snap ring, and the threaded rod 63 is rotated to drive the first clamper 30 and the second clamper 40 to oppositely rotate outward along the connection column 22, such that a distance between the first straight section 34 and the second straight section 44 and the distance between the two clamp feet 50 are changeable. Since the connection column 22 points to the snap ring, when the first clamper 30 and the second clamper 40 are rotated, the two clamp feet 50 are parallel to a virtual plane 70 of a surface of the snap ring, wherein an angle between each clamp foot and each receiving aperture of the snap ring is not changed, so each clamp foot 50 does not slide relative to the snap ring, thus connecting each clamp foot with the snap ring securely. When the snap ring is forced by each clamp foot to deform flexibly, each clamp foot does not remove from each receiving aperture of the snap ring, thus fixing or removing the snap ring safely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A snap ring pliers comprising: a handle, a first clamper, a second clamper, two clamp feet, and an adjustment structure; wherein a bottom of the handle is rotatably connected with the first clamper and the second clamper, a respective one of the two clamp feet is formed on a bottom of each of the first clamper and the second clamper, and the adjustment structure is rotatably connected with the first clamper and the second clamper so as to adjust a distance between the two clamp feet; wherein the handle includes a connection column extending from the bottom thereof, the first clamper includes a first hollow fitting ring, a first arcuate section, a second arcuate section, and a first straight section which are integrally connected, and the second clamper includes a second hollow fitting ring, a third arcuate section, a fourth arcuate section, and a second straight section which are integrally connected; the first hollow fitting ring and the second hollow fitting ring are connected with the handle, the first arcuate section curvedly extends from the first hollow fitting ring and is connected with a top of the second arcuate section, and the third arcuate section curvedly extends from the second hollow fitting ring and is connected with a top of the fourth arcuate section; a bottom of the second arcuate section is connected with a top of the first straight section, and a bottom of the fourth arcuate section is connected with a top of the second straight section, wherein the first hollow fitting ring stacks on the second hollow fitting ring so that the connection column is rotatably inserted through the first hollow fitting ring and the second hollow fitting ring so as to connecting the handle, the first clamper, and the second clamper; wherein a respective one clamp foot of the two clamp feet is inserted into the first straight section or the second straight section; wherein the adjustment structure includes a first post, a second post, a threaded rod, and a sleeve, wherein the first clamper further includes a first tubular portion and a first loop, and the second clamper further includes a second tubular portion and a second loop, such that the first post is attached to the first clamper by the first tubular portion and the first loop, the second post is attached to the second clamper by the second tubular portion and the second loop, and the first post passes through a first threaded orifice, the second post passes through a second threaded orifice, wherein a direction of a threaded section of the first threaded orifice is opposite to a direction of a threaded section of the second threaded orifice, the threaded rod has a first screwing section and a second screwing section, wherein a direction of the first screwing section extends opposite to a direction of the second screwing section, the first screwing section passes through the first threaded orifice, and the second screwing section passes through the second threaded orifice, and the sleeve is rotatably connected with the threaded rod;

wherein the first post and the second post are parallel to the connection column;

wherein a top of the first post is connected with the first tubular portion, and a bottom of the first post is connected with the first loop;

wherein a top of the second post is connected with the second tubular portion, and a bottom of the second post is connected with the second loop.

2. The pliers as claimed in claim 1, wherein the respective one clamp foot includes a shaft and an insertion extending from a bottom of the shaft, and the shaft of the respective one clamp foot is inserted into the first straight section or the second straight section, wherein the first straight section has a first screw fixed on a side thereof so as to abut against the shaft, and the second straight section has a second screw fixed on a side thereof so as to abut against the shaft.

3. The pliers as claimed in claim 1, wherein the connection column is rotatably screwed with a screw nut via the first hollow fitting ring and the second hollow fitting ring so that the screw nut stops a bottom of the first hollow fitting portion and the second hollow fitting portion.

* * * * *